United States Patent [19]

Kato et al.

[11] Patent Number: 4,586,876

[45] Date of Patent: May 6, 1986

[54] INCLINED DISC TYPE FLUID COMPRESSOR

[75] Inventors: Yoshio Kato; Toshihiro Nagamathu; Kazufumi Tsurumi, all of Toyota; Shozo Nakayama; Kimio Kato, both of Kariya, all of Japan

[73] Assignee: Taiho Kogyo Co., Ltd., Aichi, Japan

[21] Appl. No.: 766,670

[22] Filed: Aug. 16, 1985

Related U.S. Application Data

[63] Continuation of Ser. No. 393,443, Jun. 29, 1982, abandoned.

[30] Foreign Application Priority Data

Jun. 11, 1982 [JP] Japan ..... 57-99336

[51] Int. Cl.[4] ..... F04B 1/16; F04B 1/18

[52] U.S. Cl. ..... 417/269; 184/6.17

[58] Field of Search ..... 417/269; 184/6.17

[56] References Cited

U.S. PATENT DOCUMENTS

| | | | |
|---|---|---|---|
| 3,955,899 | 5/1976 | Nakayama et al. . | |
| 3,999,893 | 12/1976 | Kishi . | |
| 4,070,136 | 1/1978 | Nakayama | 417/269 |
| 4,101,249 | 7/1978 | Nakayama et al. . | |
| 4,260,337 | 4/1981 | Nomura | 417/269 |
| 4,273,518 | 6/1981 | Shibuya | 417/269 |
| 4,321,019 | 3/1982 | Degawa | 417/269 |
| 4,326,838 | 4/1982 | Kawashima | 417/269 |
| 4,347,046 | 8/1982 | Copp, Jr. et al. | 417/269 |
| 4,360,321 | 11/1982 | Copp, Jr. et al. | 417/269 |
| 4,415,315 | 11/1983 | Shiboya | 417/269 |
| 4,432,702 | 2/1984 | Honaza | 417/269 |

*Primary Examiner*—William L. Freeh

*Attorney, Agent, or Firm*—Armstrong, Nikaido, Marmelstein & Kubovcik

[57] ABSTRACT

A fluid compressor comprises a cylinder block, a driving shaft rotatably mounted in the cylinder block by means of thrust bearings and radial bearings, an inclined disk rigidly secured to the driving shaft, pistons slidably disposed in cylinder bores formed in the cylinder block, and shoes for operably connecting the inclined disk to the pistons, which are reciprocally moved in the cylinder bores when the inclined disk is rotated to pressurize gaseous fluid for cooling. In order to accommodate the inclined disk, the cylinder block has a housing, which is provided with recesses or grooves on the opposite axial end surfaces to catch the lubrication oil flowing along the inner wall of the housing. Oil ports or passages are also provided for introducing the oil from the recesses or grooves to the radial bearings. Sliding bearings may be used as the radial bearings. Such a sliding bearing may be provided with an oil guide groove or ball indents on the inner peripheral wall thereof.

10 Claims, 18 Drawing Figures

SEIZURE LOAD BY CONDITION C

SEIZURE LOAD BY CONDITION D

SEIZURE LOAD BY CONDITION A

Fig. 17 SEIZURE LOAD BY CONDITION B
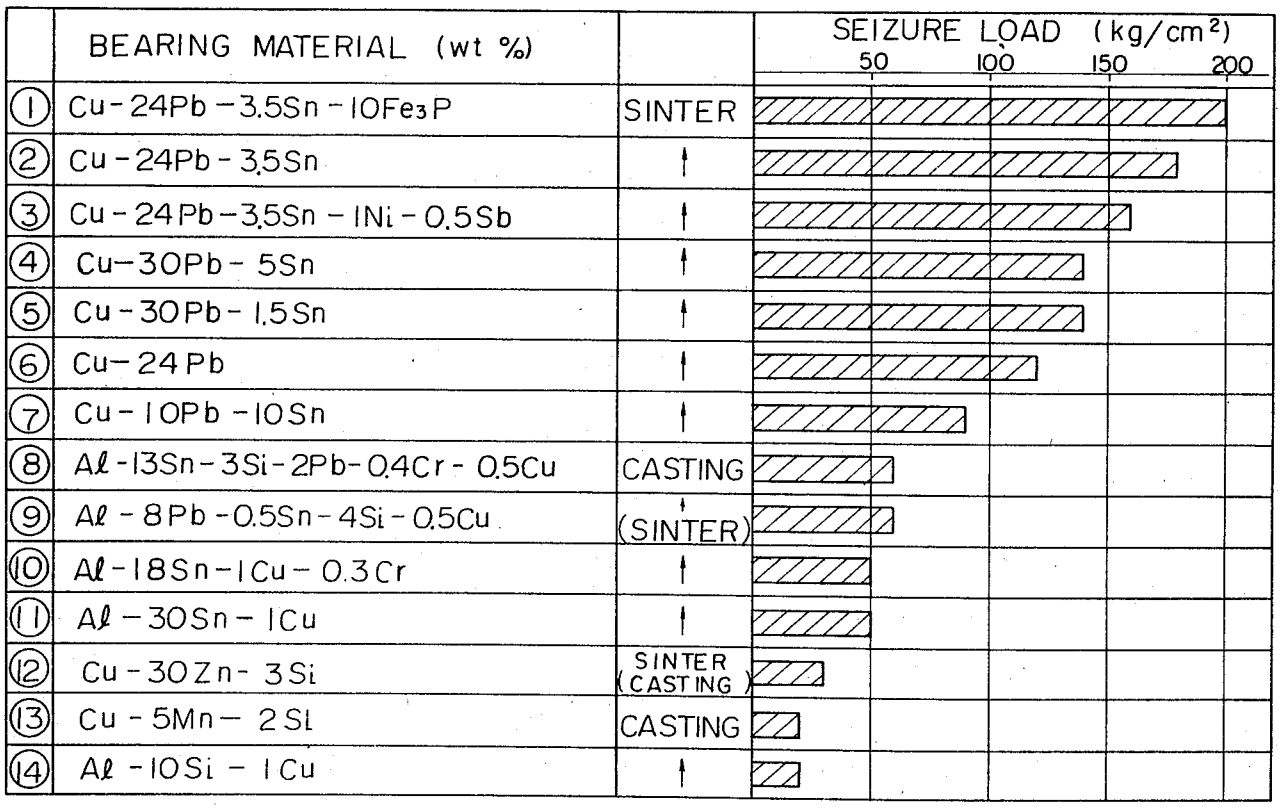

Fig. 18 SEIZURE LOAD BY UNDER CONDITIONS

| | BEARING MATERIAL (wt %) | | SEIZURE LOAD ($kg/cm^2$) | | | | |
|---|---|---|---|---|---|---|---|
| | | | MEDIUM CONDITION | | CONDITION B OIL PORT | CONDITION A OIL PORT | CONDITION A OIL PORT BALL INDENT |
| | | | NO OIL PORT | OIL PORT | | | |
| 1 | Cu-24Pb-3.5Sn-10$Fe_3P$ | SINTER | | | | | |
| 2 | Cu-24Pb-3.5Sn | ↑ | × | ○ | ○ | △ | ○ |
| 3 | Cu-24Pb-3.5Sn-1Ni-0.5Sb | ↑ | × | ○ | ○ | △ | ○ |
| 4 | Cu-30Pb-5Sn | ↑ | × | ○ | ○ | △ | ○ |
| 5 | Cu-30Pb-1.5Sn | ↑ | × | ○ | ○ | △ | ○ |
| 6 | Cu-24Pb | ↑ | × | ○ | ○ | △ | ○ |
| 7 | Cu-10Pb-10Sn | ↑ | × | ○ | ○ | △ | ○ |
| 8 | Al-13Sn-3Si-2Pb-0.4Cr-0.5Cu | CASTING | × | ○ | ○ | × | ○ |
| 9 | Al-8Pb-0.5Sn-4Si-0.5Cu | ↑ (SINTER) | × | ○ | ○ | × | ○ |
| 10 | Al-18Sn-1Cu-0.3Cr | ↑ | × | ○ | ○ | × | △ |
| 11 | Al-30Sn-1Cu | ↑ | × | ○ | ○ | × | △ |
| 12 | Cu-30Zn-3Pb | SINTER | × | ○ | × | × | × |
| 13 | Cu-5Mn-2Si | CASTING | × | ○ | × | × | × |
| 14 | Al-10Si-1Cu | ↑ | × | ○ | × | × | × |

INCLINED DISC TYPE FLUID COMPRESSOR

This application is a continuation of application Ser. No. 393,443, filed June 29, 1982, now abandoned.

BACKGROUND OF THE INVENTION

The present invention relates to a fluid compressor, more particularly to a fluid compressor having an inclined disk, hereinafter referred to as "inclined disk type fluid compressor", such as has recently become widely used in automobile air-conditioning systems.

An inclined disk type fluid compressor comprises a cylinder block, a driving shaft rotatably mounted in said cylinder block, an inclined disk plate rigidly secured to said driving shaft, pistons slidingly disposed in cylinder bores formed in said cylinder block, and shoe means for operatively connecting said inclined disk to said pistons, so that said pistons are slidingly and reciprocally moved in said cylinder bores when the inclined disk is rotated, thereby compressing fluid, such as, gas media for cooling. In an inclined disk type fluid compressor having no lubrication pump, lubrication oil is mixed with the fluid to be compressed in the form of mist, which is supplied to the portions of the compressor to be lubricated. Such a lubrication system, however, is not that efficient. The efficiency is especially poor in compressors for automobile air-conditioning systems, since there is a tendency in such compressors to reduce the amount of lubrication oil in the gas cooling media in order to improve the cooling capacity. Therefore, ball or roller bearings have conventionally been used for all radial bearings rotatably supporting said driving shaft in the cylinder block. It has been difficult to use less expensive sliding bearings for the same purpose.

SUMMARY OF THE INVENTION

An object of the present invention is to provide an inclined disk type fluid compressor in which the lubrication efficiency is improved, whereby less expensive sliding bearings can be used for the radial bearings of compressors.

Another object of the present invention is to provide an inclined disk type fluid compressor in which improved sliding bearings are used as radial gearings, whereby lubrication efficiency can be much improved.

The gist of the present invention is based on the fact that the lubrication oil contained in the fluid to be compressed is supplied to the inclined disk, spread to the peripheral wall by the rotational centrifugal force of the inclined disk, then flows down along the opposite side walls of the chamber accommodating the inclined disk. The lubrication oil flowing down on the side walls is effectively caught and introduced to the radial bearings.

According to the present invention, there is provided an inclined disk type compressor comprising: a cylinder block; a driving shaft rotatably mounted in said cylinder block by means of thrust bearings and radial bearings; a disk rigidly secured to said driving shaft at a certain inclined angle with respect to the axis of said driving shaft; said cylinder block having a housing for accommodating said inclined disk so as to allow the rotation of the latter; said cylinder block having cylinder bores which are arranged in parallel to the axis of said driving shaft; the opposite ends of each said cylinder bore being communicated with a suction passage and a discharge passage via a suction valve and a discharge valve, respectively; compressor pistons slidingly disposed in said cylinder bores; shoe means for operatively connecting the peripheral portion of said inclined disk to said compressor pistons so as to cause the reciprocal movement of said compressor pistons upon the rotation of said inclined disk; said radial bearings being arranged at positions apart from said housing which is communicated with said suction passage so that gaseous fluid containing lubrication oil is introduced into said housing; said housing being provided on the opposite axial end walls with recesses for receiving lubrication oil flowing down along said end surfaces; and said radial bearings being communicated with said recesses through oil passages opened to the latter.

BRIEF DESCRIPTION OF THE DRAWINGS

The present invention may be more fully understood from the following description of preferred embodiments of the invention given in reference to the accompanying drawings, wherein.

DESCRIPTION OF PREFERRED EBMODIMENTS

Figure 1:
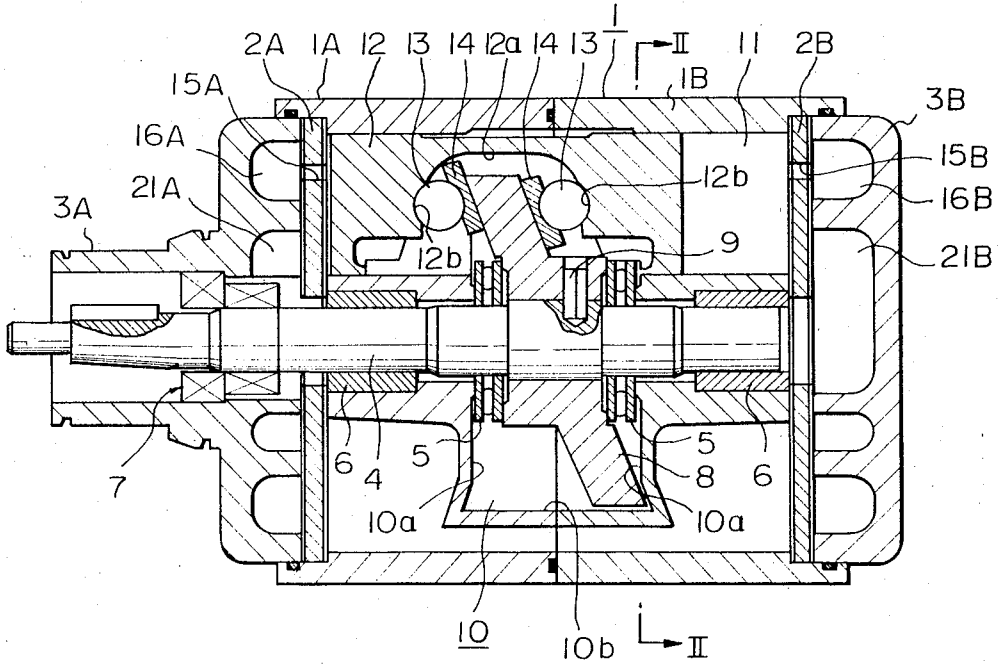
FIG. 1 is a longitudinal cross-sectional view of an inclined disk type fluid compressor of this invention taken along the line I—I in FIG. 2.

Referring now to the drawings, there is shown in FIG. 1 an embodiment of an inclined disk type fluid compressor of the present invention, wherein a cylinder block 1 is formed of two cylinder block bodies, i.e., a front cylinder block 1A and a rear cylinder block 1B, which are rigidly connected to each other. At one end of the cylinder block 1, a front cylinder head 3A is rigidly secured thereto through a valve plate 2B. At the other end thereof, a rear cylinder head 3B is rigidly secured thereto through a valve plate 2B. In the cylinder block 1, there is a driving shaft 4 which is rotably supported in said cylinder block 1 by a pair of thrust bearings 5 and a pair of radial bearings 6. One end of the driving shaft 4 is extended through axial slots of the valve plate 2A and the front cylinder head 3A and is connected to a drive source (not shown). A mechanical seal member 7 is provided between the axial slot of the front cylinder head 3A and the driving shaft 4 so as to fluid tightly keep the interior of the cylinder block 1.

Figure 2:
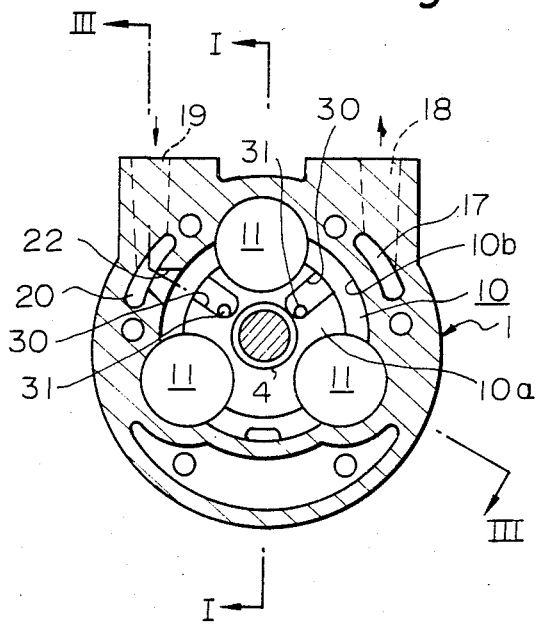
FIG. 2 is a cross-sectional view taken along the line II—II in FIG. 1 and illustrating the fluid compressor with some parts omitted.

At the central portion in the cylinder block 1, an inclined plate 8 is rigidly secured to the driving shaft 4 by means of pins 9. The inclined plate 8 is a disk plate which is secured to the driving shaft 4 so that it is inclined at a certain angle with respect to the axis of the driving shaft 4. In the cylinder block 1, there is formed with a chamber 10 wherein said inclined disk 8 is accommodated so that it is allowed to rotate. The above-mentioned thrust bearings 5 are disposed between the opposite sides of the inclined disk 8 and the opposite inner walls 10*a* of the chamber 10, respectively. As shown in FIGS. 1 and 2 the cylinder block 1 is therein formed with three cylinder bores 11 spaced from each other at equal angles, that is 120° (FIG. 2), which bores 11 extend in parallel to the driving shaft 4 through the inclined disk chamber 10 and is communicated with the chamber 10. Within each cylinder bore 11, a piston 12 is slidingly fitted. Although each cylinder bore 11 is communicated at the central portion thereof with the chamber 10, the front and rear cylinder chambers defined by the piston 12 are not communicated with the chamber 10 wherever the piston 12 is positioned.

Each piston 12 has formed at the central portion thereof a recess 12*a* which houses the peripheral portion of the inclined disk 8. At the axially opposite faces of the recess 12*a*, there are provided a pair of semi-spherical cavities 12*b*. A ball 13 and a shoe 14 are interposed between each semi-spherical cavity 12*b* of the piston 12 and each side face of the inclined disk 8 so that the pistons 12 are operatively connected to the inclined disk 8.

The above-mentioned structure of the inclined disk type compressor is not basically different from that of a conventionally known inclined disk type compressor and operates as follows. When the driving shaft 4 is rotated by any suitable known manner, the inclined disk 8 integrally formed thereto is rotated, thereby reciprocally moving the pistons 12 to compress the gaseous fluid in the cylinder bores 11. The pressurized gaseous fluid is, then, discharged through ports 15A and 15B formed in the valve plates 2A and 2B and through discharge valves (not shown) into respective discharge chambers 16A and 16B. The fluid is then discharged through ports 17 (FIG. 2) connected to the chambers 16A and 16B and through discharge passage 18 (FIG. 2) to the outside of the compressor. On the other hand, gaseous fluid to be pressurized is sucked from an inlet port 19 and introduced through passages 20 (FIGS. 2 and 3), by which the direction of its flow is changed, into a pair of suction chambers 21A and 21B. The fluid is sucked from there through suction valves (not shown), and through ports (not shown) formed in the valve plates 2A and 2B into the cylinder bores 11. As clearly understood from the above description, the suction valve and the discharge valve (not shown) serve as one-way valves which introduce the gaseous fluid toward the direction of suction and the direction of discharge, respectively.

The chamber 10 accommodating the inclined disk 8 is communicated with said suction passage 20 via a port 22 (FIGS. 2 and 3), so that the lubrication oil contained in the gaseous fluid to be pressurized is introduced from the port 22 into the chamber 10 due to inertia and gravity, then is supplied in the form of mist to the sliding portions of the inclined disk 8, the thrust bearings 5, and so on.

Figure 3:
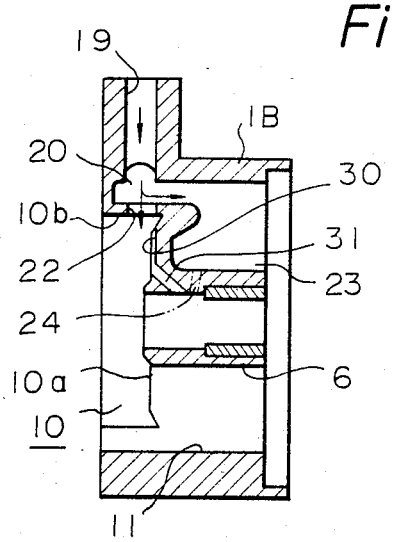
FIG. 3 is a cross-sectional view taken along the line III—III in FIG. 2.

According to the prior art, the radial bearings 6 are lubricated by introducing the lubrication oil supplied to the thrust bearings 5 into the annular clearance defined between the driving shaft 4 and the axial slot of the cylinder block 1 for receiving said driving shaft 1 and by supplying it to the radial bearings 6. According to another instance of the prior art, as shown in FIG. 3, the cylinder block 1 is provided with hollow portions 23 at the positions between the cylinder bores 11 in order to reduce the weight of the cylinder block 1, said each hollow portion being used as a portion of said passage 20, so that the lubrication oil separated from the gaseous fluid to be pressurized within the hollow portions 23 is introduced to the radial bearings 6 through ports 24, as shown by the imaginary lines in FIG. 3. In either case, however, the amount of the lubrication oil which can be introduced to the radial bearings 6 is so small that it is practically impossible to use sliding bearings as the radial bearings 6.

The present invention is principally based on the fact that the lubrication oil supplied to the inclined disk 8 is spread to the inner peripheral wall 10*b* and the side walls 10*a* of the chamber 10 due to centrifugal force by the rotation of the inclined disk 8. In addition, the lubrication oil contained in the gaseous fluid is supplied to said inner peripheral wall 10*b* and side walls 10*a*, due to the circumferential flow of the gaseous fluid in the chamber 10 by the rotation of the inclined disk 8 and due to the reciprocal flow of the gaseous fluid in the cylinder bores 11 by the reciprocal movement of the pistons 12. Especially, the lubrication oil attached to the inner peripheral wall 10*b* readily flows down through the side walls 10*a* of the chamber 10. According to the present invention, in consideration of the above-mentioned fact, there is provided recesses or grooves 30 on the side walls 10*a* for effectively catching the lubrication oil flowing down along said side walls 10*a*, as shown in FIGS. 2 and 3. According to the illustrated embodiment, as one of the cylindrical bores 11 is arranged at the top central portion in the cylinder block 1 (that is to say, at the position above the driving shaft 4), for each of said side walls 10*a* two recesses 30 are provided at respective sides with respect to the top cylindrical bore 11, as seen from FIG. 2. In addition, the lubrication oil, which flows down along the side walls 10*a*, readily flows down in the direction of the rotation of the inclined disk 8 under the influence of the rotation thereof, especially when the inclined disk 8 is rotating at high speed. It is preferable to provide a large catching area for receiving the lubrication oil. It is, therefore, desired that the recesses or grooves 30 be formed so as to outwardly extend along the radial line extending from the center of the driving shaft 4. Further, the cylinder block 1 is provided with ports 31 bored therein for connecting the bottom portion of each recess or groove 30 to the corresponding radial bearing 6.

According to the above-mentioned structure of the present invention, the lubrication oil flowing down on the side walls 10*a* is effectively received or caught in the recesses or grooves 30 and introduced to the radial bearings 6 through the ports 31, so that the amount of lubrication oil supplied to the radial bearings 6 can be increased as compared to the structure of the prior art.

Figure 4:
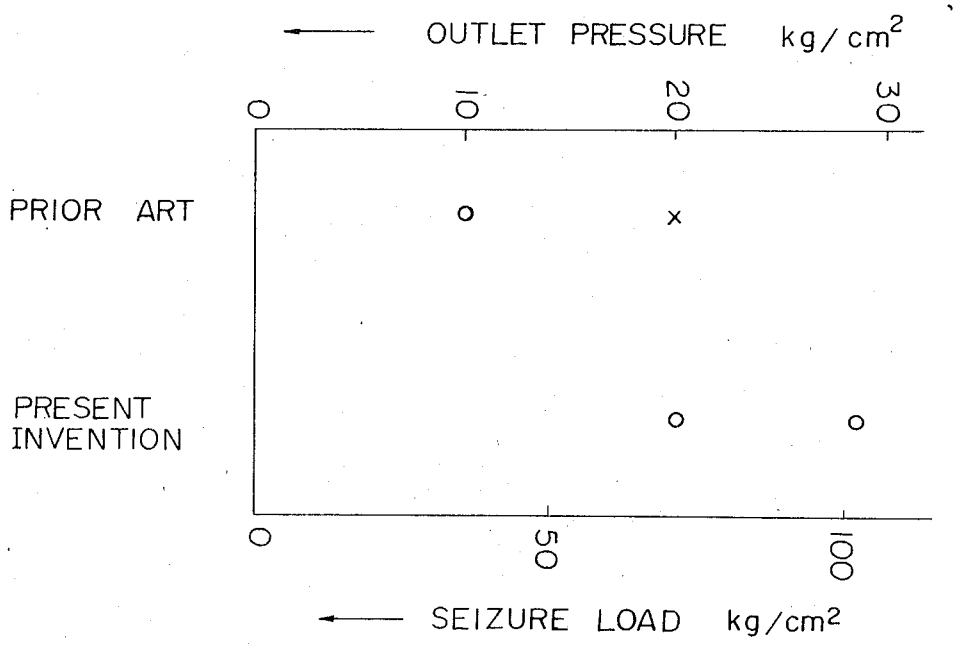
FIG. 4 is a diagram illustrating the experimental results of a seizure test with respect to a compressor of this invention and a compressor of the prior art.

FIG. 4 is a diagram illustrating the experimental results of a seizure test of sliding bearings with respect to an inclined disk type fluid compressor of the present invention and a compressor of the prior art having the above-mentioned port 24 (FIG. 3), wherein for both compressors the same sliding bearings were used as radial bearings and the discharge pressure was changed at three stages. The conditions of the experiment were as follows:

Compressor: Inclined disk type fluid compressor

Discharge pressure: Pd=10 kg/cm$^2$, 20 kg/cm$^2$, 28 kg/cm$^2$

Suction pressure: Ps=2 kg/cm$^2$

Lubrication oil: Oil for cooling system (Predetermined amount of oil)

Material of driving shaft: Steel shaft

Material of plain bearing: Al-Sn alloy

In FIG. 4, symbol o indicates no seizure and symbol x indicates seizure. The seizure load in FIG. 4 was obtained by calculations based on the discharge pressure, that is to say, the seizure load is represented as the pressure exerted on the radial bearings 6 at the time of a particular discharge pressure. As understood from the experimental results illustrated in FIG. 4, in the compressor of the prior art, the plain sliding bearings were seized when the discharge pressure was 20 kg/cm$^2$. In the compressor of the present invention, however, the sliding plain bearings did not seize even when the discharge pressure was increased to 28 kg/cm$^2$. In consideration of the above-mentioned fact, it should be noted that according to the present invention, sliding bearings can be sufficiently used as the radial bearings of the inclined disk type fluid compressor, because the amount of the lubrication oil supplied to the radial bearings is much increased as compared with that of the prior art. As sliding plain bearings can be used according to the present invention, it makes possible to avoid so-called abrasive wearing of the bearings and, therefore, to obtain stable rotation of the inclined disk 8. Contray to this, if ball or roller bearings would be used as the radial bearings as in the prior art, the balls or rollers and/or the housings of the bearings could be readily worn out by abrasion due to the dynamic rotational load exerted to the shaft of the inclined disk, so that stable rotation of the inclined disk could not be obtained.

Figure 5:
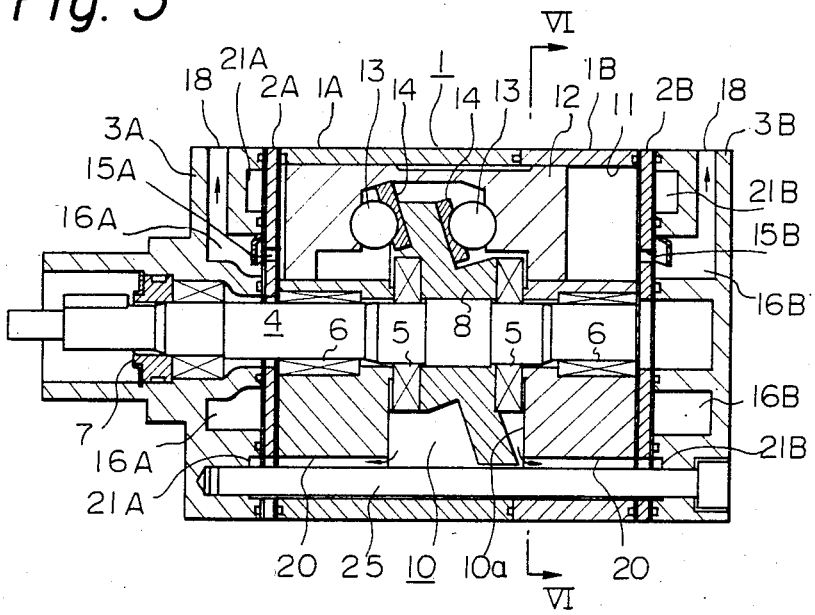
FIG. 5 is a longitudinal cross-sectional view of another embodiment of an inclined disk type fluid compressor of this invention.
Figure 6:
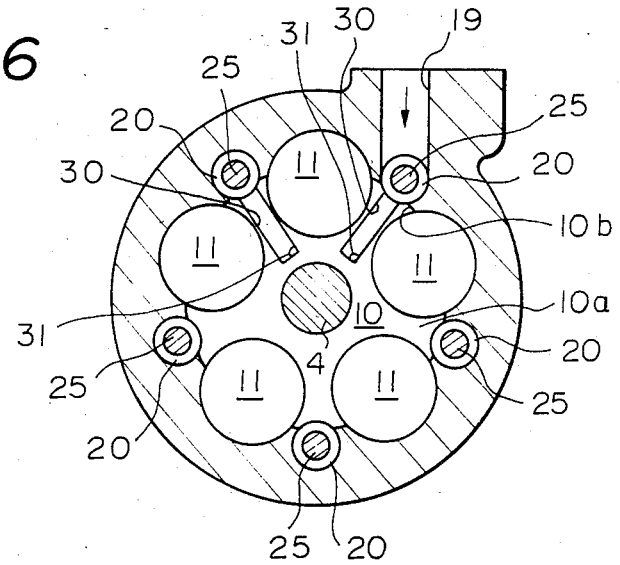
FIG. 6 is a cross-sectional view, similar to FIG. 2, taken along the line VI—VI in FIG. 5.

Although the above-mentioned embodiment relates to an inclined disk type, three cylinder fluid compressor having three cylinder bores 11, it will be understood that this invention may be easily applied to an inclined disk type fluid compressor having different numbers of cylinders. FIGS. 5 and 6 illustrate an embodiment of an inclined disk type fluid compressor having five cylinders, to which the present invention is applied. In these drawings, the same or corresponding parts as that of the embodiment shown in FIGS. 1 through 3 are indicated by the same references numerals. In an inclined disk type five-cylinder fluid compressor, block portions between cylinder bores 11 are relatively narrow and, therefore, it is difficult to provide discharge and suction ports in said portions. Therefore, according to this embodiment, there are formed ports 20 around bolts 25 which interconnect cylinder blocks 1A and 1B, valve plates 2A and 2B, and cylinder heads 3A and 3B; and suction chambers 21A and 21B provided at the opposite sides of the compressor are interconnected through said ports 20, which are also communicated with a chamber 10 for accommodating an inclined disk 8. In this embodiment, recesses or grooves 30 for catching the lubrication oil and ports 31 for introducing the lubrication oil to radial bearings 6 may be provided in the same manner as the above-mentioned embodiment shown in FIGS. 1 through 3. Therefore, it is clearly understood that with the present embodiment, the same function and effects can be obtained as that of the above-mentioned embodiment.

In the above-mentioned embodiments, the recesses or grooves 30 may be advantageously formed at positions where the lubrication oil caught thereby is easily supplied to the radial bearings 6 by gravity, that is to say, at positions above the level which contains the lower portions of the radial bearings 6.

It will be understood that various modifications may be made within the scope of the present invention defined by the appended claims. For instance, if the diameter of the ports 31 can be increased, the portion of each port 31 opened to the side wall 10*a* of the chamber 10 may be used as the recess or groove 30 for catching the lubrication oil. Otherwise, if the lower portion of each recess or groove 30 can be extended to the gap defined between the driving shaft 4 and the axial slot of the cylinder block 1, said gap may be used in place of the port 31 as an oil passage for introducing the lubrication oil having been caught by the recess or groove 30 to the radial bearing 6. In addition, it is preferable to arrange the inlet port 19 right above the recess or groove 30 so that the lubrication oil separated from the gaseous fluid flows along the peripheral wall of the inlet port 19 is directly received in said recess or groove 30.

As clearly understood from the above description, according to the present invention, the lubrication efficiency for the radial bearings of an inclined disk type fluid compressor is much improved, so that sliding bearings can be used as the radial bearings 6. The sliding bearings 6 used in the present invention may be constituted by various types.

Figure 7:
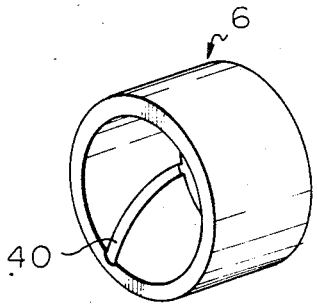
FIG. 7 is a perspective view of an embodiment of a sliding bearing used in the present invention.
Figure 8:
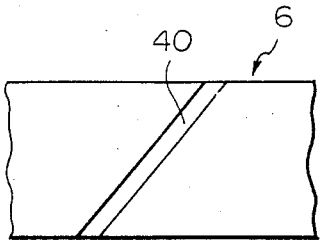
FIGS. 8 and 9 are development plan views illustrating the inner surface of sliding bearings used in the present invention.
Figure 9:
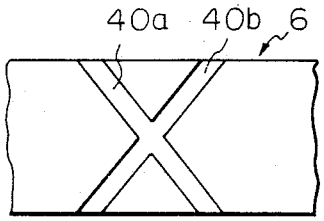
Figure 10:
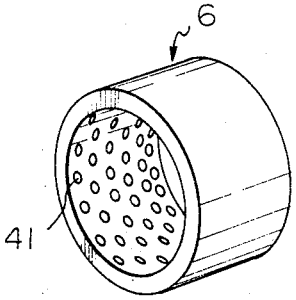
FIGS. 10 and 11 are perspective views of other embodiments of sliding bearings used in the present invention.
Figure 11:
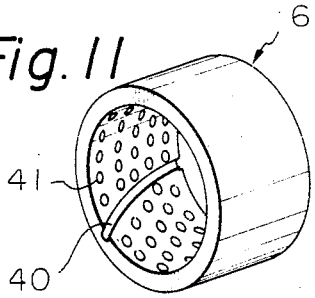

FIGS. 7, 10 and 11 illustrate different types of sliding bearings which may be used in an inclined disk type fluid compressor of the present invention. In an embodiment shown in FIG. 7, a continuous oil guide groove 40 is formed on the inner peripheral wall of the sliding bearing 6. The oil guide groove 40 advantageously extends from one axial end of the sliding bearing 6 to the other axial end thereof (in other words, the guide groove 40 is opened at the opposite axial ends of the bearing) and in the direction inclined with respect to the central axis of the sliding bearing 6, in order to increase the amount of oil being supplied thereto. In addition, it is desired that the sliding bearing 6 is arranged so that the guide groove 40 is substantially positioned at the lowerportion of the bearing 6 so as to easily store the lubrication oil in said oil guide groove 40 when this compressor is stopped. FIGS. 8 and 9 are development plan views illustrating the inner wall of the sliding bearing 6. In an embodiment shown in FIG. 8, a countinuous oil guide groove 40 is formed so that it is inclined with respect to the central axis of the sliding bearing 6, as mentioned above. In an embodiment shown in FIG. 9, there are formed two continuous oil guide grooves 40*a* and 40*b* which are inclined with respect to the central axis of the sliding bearing 6 and intersect with each other. The cross-section of the groove 40, 40*a* or 40*b* may be made in any suitable configuration, such as, semicircular, U-shaped or reverse trapezoid.

In an embodiment shown in FIG. 10, a plurality of small indents, such as ball indents 41, are formed on the inner peripheral wall of the sliding bearing 6, in place of the oil guide groove 40, 40*a* or 40*b* provided in the above-mentioned embodiments shown in FIGS. 7 through 9. Such ball indents 41 may be regularly arranged in a checkered or staggered manner or may be arranged at random. In either case, it is preferable to arrange the ball indents 41 uniformly over the whole inner wall of the sliding bearing 6. In an embodiment shown in FIG. 11, the sliding bearing 6 is provided on the inner peripheral wall thereof with both a continuous oil guide groove 40 as shown in FIG. 7 and a plurality of ball indents 41 as shown in FIG. 10.

The lubrication oil supplied to the sliding bearing 6 through said recesses or grooves 30 and the ports 31 can be spread over the whole inner surface of the sliding bearing 6 by means of the oil guide groove 40, 40*a* or 40*b*, and/or the plurality of ball indents 41 provided on the inner wall of the bearing 6 which slidingly contacts with the driving shaft 4. When the driving shaft 4 is stopped, the lubrication oil readily accumulates in the oil guide groove 40. When the driving shaft 4 is rotating, the lubrication oil in the oil groove 40 is spread in the circumferential direction to form an oil film between the inner peripheral wall of the sliding bearing 6 and the driving shaft 4. Thus, the lubrication efficiency is improved for the radial bearings of an inclined disk type fluid compressor according to the present invention. The oil guide groove 40, 40*a* or 40*b* serves not only to supply the lublication oil to the inner surface of the sliding bearing 6, but also to permit the cooling media to pass therethrough so that the sliding bearing is prevented from being overheated and seized with the driving shaft 4.

The plain sliding bearing used as a radial bearing 6 may be advantageously made of any suitable seizure proof or wear proof metal, such as:

(1) Al-Sn alloy consisting of Al basic material, 3.5–35 weight % Sn (hereinafter, % means weight %), and 1.0–10% two or more elements including at least Cr, selected in the group of Cr, Si, Mn, Sb, Ti, Zr, Ni, Fe, W, Ce, Nb, V, Mo, Ba, Ca, or Co. Al-Sn alloy including not more than 3% Cu or/and Mg, and/or including not more than 9% one or more elements selected in the group of Pb, Bi, Tl, Cd, In, or Zn, in addition to the above-mentioned components.

(2) Al-Pb alloy consisting of Al basic material, 2–10% preferably 5–10% Pb, and/or 3–35% Sn, and/or not more than 3% one or more elements selected in the group of Cr, Si, Mn, Sb, Ti, Zr, Ni, Fe, W, Ce, Nb, V, Mo, Ba, Ca, or Co. In addition to this, it may contain not more than 9% one or more elements selected in the group of Bi, Tl, Cd, In, or Zn.

(3) Cu-Pb alloy consisting of Cu basic material, 5–35%, preferrably 15–28% Pb, and/or 0.1–10% Sn, and/or not more than 3% one or more elements selected in the group of Ni, Mn, Fe, Be, Zr, Al, Sb, or Si.

Again, in FIGS. 12 through 18, the experimental results of seizure test are illustrated, in which the bench test conditions for incliend disk type fluid compressors were as follows:

BENCH TEST CONDITIONS

| | | Conditions | | | |
|---|---|---|---|---|---|
| | | A | B | C | D |
| Load [kg] ① | | 30 | 480 | 110 | 110 |
| Speed [m/s] ② | | 3.4 | 5.4 | 0.6 | 3.8 |
| Lubrication Oil | | Referigeration oil (Fog Lubrication) | | | |
| Oil quantity ③ | 10P ④ | 80 cc | | | |
| | 6P ⑤ | 230 cc | | | |
| Cooting media (Refrigerant gas) | | Freon R-12 | | | |
| Shaft Material | | S55C (Temper Hardness $_M$Hv. 700) | | | |
| Bearing Material | | HF16 ⑥ | HF16 ⑥ | HF16 ⑥ | HF16 ⑥ |
| | | Other Material | | | |
| Test Time [Hrs] | | 20 | ON 10 min / OFF 110 min } 25 Times | 1000 | 1000 |

Condition A: Lack of gas (carrier) to be compressed
Condition B: High load and high speed, severe condition; Turned on and off alternately
Condition C: Low speed and high pressure, endurance test
Condition D: High speed and high pressure, endurance test
Note:
① "Load" means the load exerted on the driving shaft.
② "Speed" means the relative peripheral speed between the shaft and the plain sliding bearing.
③ "Oil quantity" means the quantity of oil existing in the whole circuit of the compressor.
④ "10P" means five cylinder compressor as shown in FIGS. 5 and 6.
⑤ "6P" means three cylinder compressor as shown in FIGS. 1 and 2.
⑥ "HF16" means Cu—23Pb—3.5Sn—3Zn (Cu—Pb alloy consisting of Cu basic material, 23% Pb, 3.5% Sn, and 3% Zn)

Figure 12:
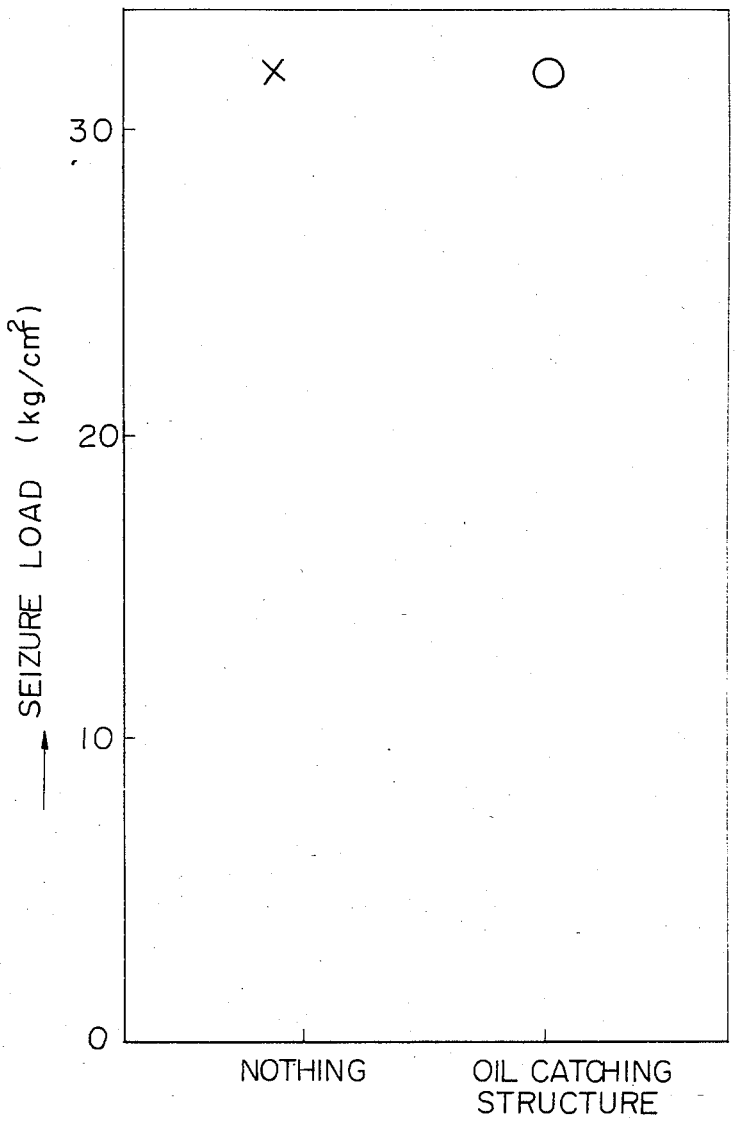
FIGS. 12 thought 18 are diagrams illustrating the experimental results of seizure test under the various conditions.

As seen from FIG. 12, under the condition C it was found that a plain bearing could be effectively used in a compressor having oil catching structure (recess or grooves 30 and oil ports 31) over 30 kg/cm$^2$. A compressor having no oil catching structure could not be effectively used over 30 kg/cm$^2$.

Figure 13:
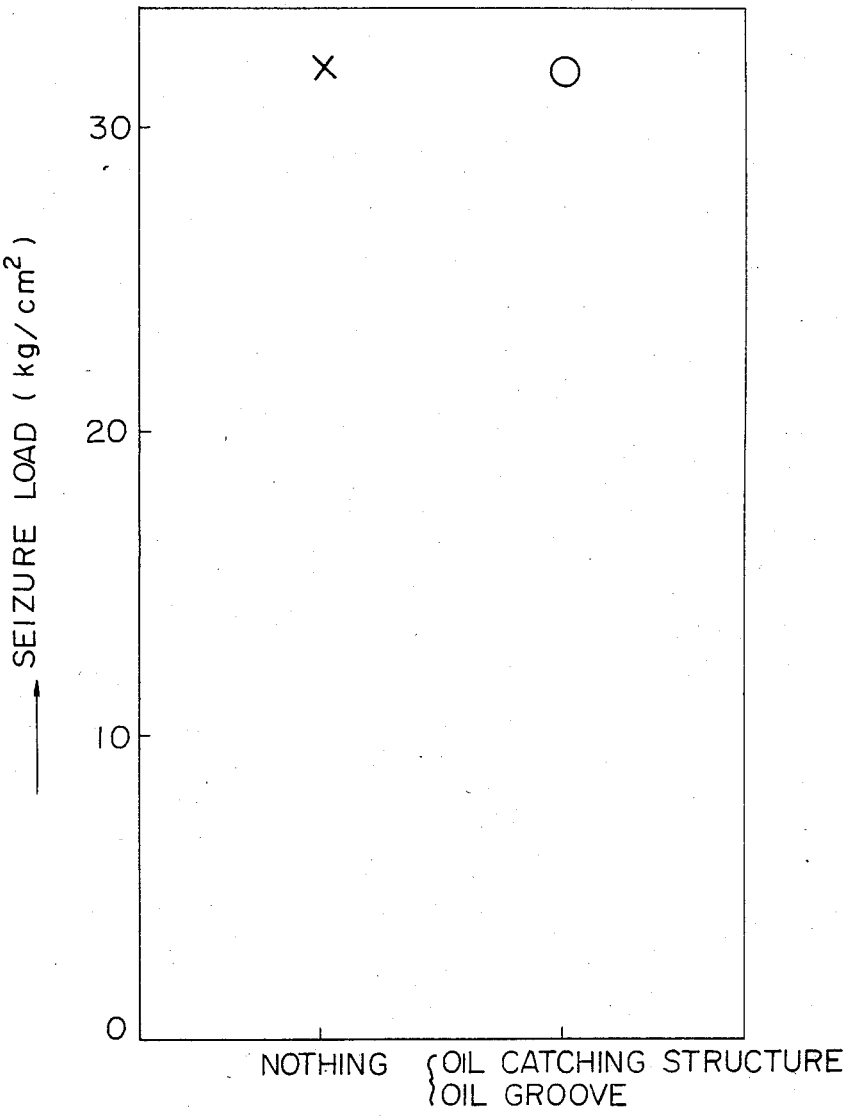

FIG. 13 illustrates that under the condition D a plain bearing could be effectively used in a compressor having oil cathing structure and oil groove (oil guide groove 40) over 30 kg/cm$^2$. A compressor having neither oil catching structure nor oil groove could not be effectively used.

Figure 14:
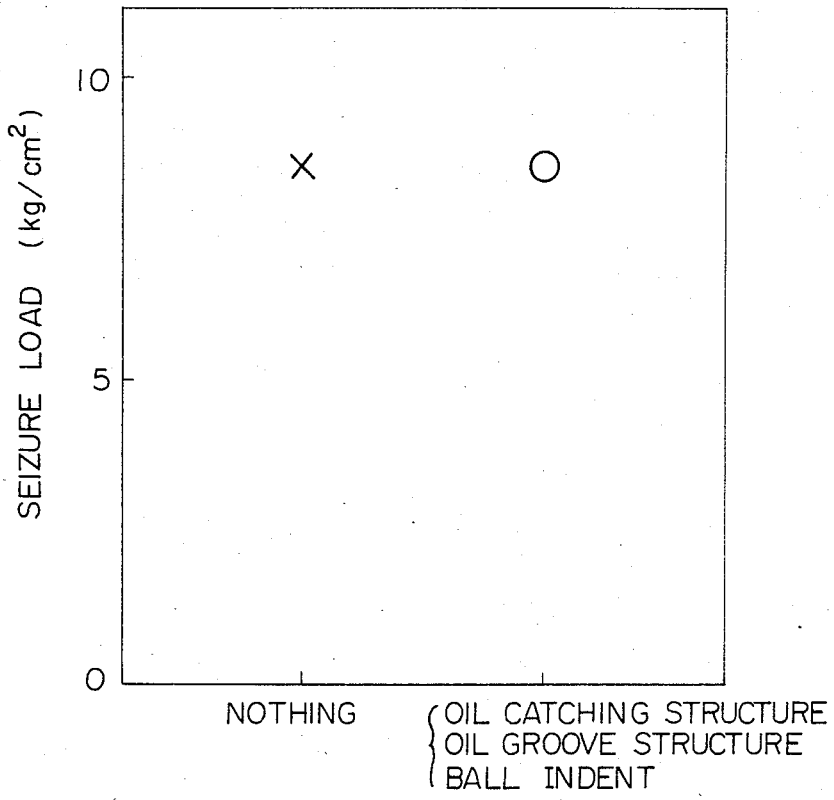

FIG. 14 illustrates that under the condition A, a plain bearing could be effectively used over 8 kg/cm$^2$ in a compressor having oil catching structure, oil groove structure and ball indent (ball indents 41).

Figure 15:
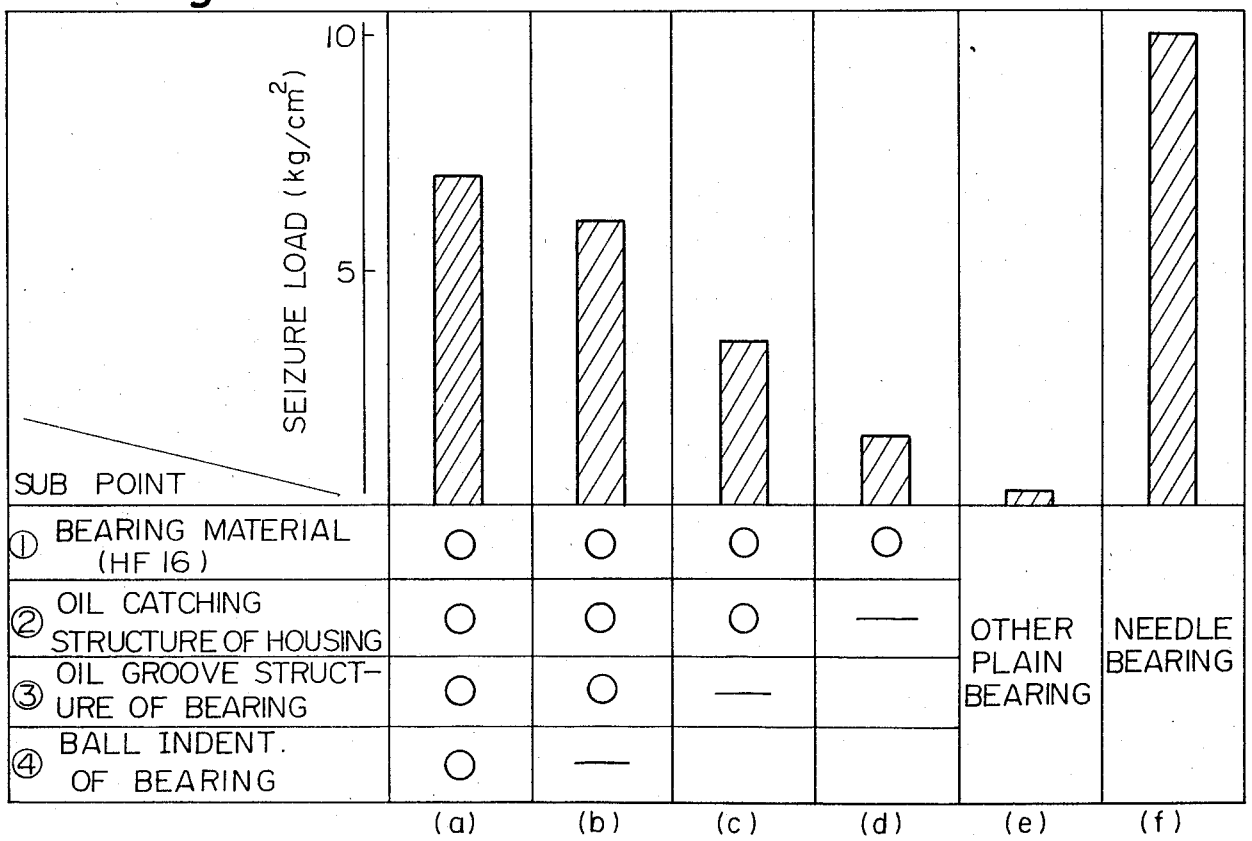

In FIG. 15, seizure load under the test condition A is shown for six cases, that is, compressors having plain bearings of (a) HF 16, oil catching structure, oil groove structure and ball indent, (b) HF 16, oil catching structure and oil groove structure, (c) HF 16 and oil catching structure, (d) HF 16, (e) compressor having other plain bearings, and (f) compressor having needle bearings.

Figure 16:
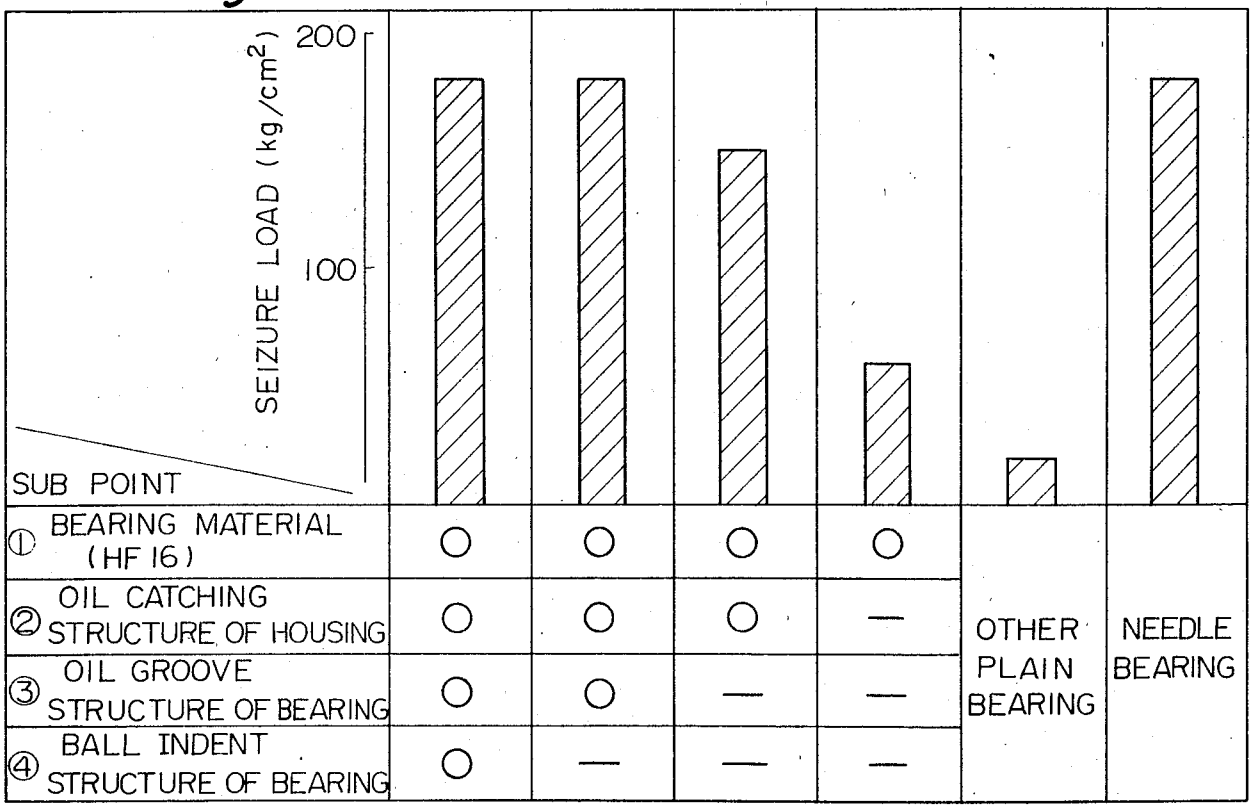

FIG. 16 is a similar illustration of seizure load as FIG. 15, but under the test condition B.

FIG. 17 shows the experimental results of seizure load under the test condition B, but in this case plain bearings with various materials were used. Bearing materials of (12), (13) and (14) are so called comparative samples.

FIG. 18 illustrates whether the plain bearings with various materials satisfactory met the necessary requirements under the various conditions. Symbol O indicates that the bearing was satisfactory used under predetermined conditions. Symbol X indicates that the bearing could not be used under the predetermined conditions. Symbol Δ indicates that the bearing could be used, but did not fully meet the necessary requirements. Bearing materials (12), (13) and (14) are so called comparative samples.

We claim:

1. An inclined disk type compressor comprising: a cylinder block; a driving shaft rotatably mounted in said cylinder block by means of thrust bearings and radial bearings; a disk rigidly secured to said driving shaft at a certain inclined angle with respect to the axis of said driving shaft; said cylinder block having a chamber for accommodating said inclined disk so as to allow the rotation of the latter; said cylinder block having cylinder bores which are arranged in parallel to the axis of said driving shaft; the opposite ends of each said cylinder bore being communicated with a suction passage and a discharge passage via a suction valve and a discharge valve, respectively; compressor pistons slidingly disposed in said cylinder bores so that gaseous fluid containing lubrication oil is compressed in said cylinder bores by said pistons; shoe means for operatively connecting the peripheral portion of said inclined disk to said compressor pistons so as to cause the reciprocal movement of said compressor pistons upon the rotation of said inclined disk; said radial bearings being sliding radial bearings arranged at positions apart from said chamber which is communicated with said suction passage so that at least a part of the gaseous fluid containing lubrication oil is introduced into said chamber and then introduced into said cylinder bores after having been passed through said chamber; said chamber being provided on the opposite axial internal end walls with grooves for receiving lubrication oil flowing down along internal end surfaces; and said radial bearings being communicated with said grooves through oil passages which are bored in the cylinder block so as to be open to said grooves and introduce the lubrication oil to said radial bearings.

2. A compressor as set forth in claim 1, wherein said cylinder bores are arranged around the axis of said driving shaft and spaced from each other at equal angles, and said grooves for receiving lubrication oil are provided internal end walls at positions between said cylinder bores.

3. A compressor as set forth in claim 2, wherein said grooves are provided in the upper position with respect to the axis of said driving shaft.

4. A compressor as set forth in claim 2 or 3, wherein said grooves are extended along the radial line passing through the axis of said driving shaft.

5. A compressor as set forth in claim 1, wherein said sliding radial bearing is provided on the inner peripheral surface thereof with at least one continuous groove.

6. A compressor as set forth in claim 5, wherein said at least one continuous groove extends from one axial end of said sliding radial bearing to the other axial end thereof.

7. A compressor as set forth in claim 6, wherein said at least one continuous groove is inclined with respect to the axis of said sliding radial bearing and helically extends on the inner peripheral surface thereof.

8. An inclined disk type compressor comprising: a cylinder block; a driving shaft rotatably mounted in said cylinder block by means of thrust bearings and radial bearings; a disk rigidly secured to said driving shaft at a certain inclined angle with respect to the axis of said driving shaft; said cylinder block having a housing for accommodating said inclined disk so as to allow the rotation of the latter; said cylinder block having cylinder bores which are arranged in parallel to the axis of said driving shaft; the opposite ends of each said cylinder bore being communicated with a suction passage and a discharge passage via a suction valve and a discharge valve, respectively; compressor pistons slidingly disposed in said cylinder bores; shoe means for operatively connecting the peripheral portion of said inclined disk to said compressor pistons so as to cause the reciprocal movement of said compressor pistons upon the rotation of said inclined disk; said radial bearings each being sliding radial bearings provided on the inner peripheral surface thereof with a plurality of ball indents, said radial bearings being arranged at positions apart from said housing which is communicated with said suction passage so that gaseous fluid containing lubrication oil is introduced into said housing; said housing being provided on the opposite axial internal end walls with grooves for receiving lubrication oil flowing down along internal end surfaces; and said radial bearings being in communication with said grooves though oil passages, which are bored in the cylinder block so as to be open to said grooves and introduce the lubrication oil to said radial bearings.

9. A compressor as set forth in claim 8, wherein said at least one continuous groove extends from one axial end of said sliding radial bearing to the other axial end thereof.

10. A compressor as set forth in claim 9, wherein said at least one continuous axial groove is inclined with respect to the axis of said sliding radial bearing and helically extends on the inner peripheral surface thereof.

* * * * *